US005951443A

United States Patent [19]

Askins

[11] Patent Number: 5,951,443

[45] Date of Patent: Sep. 14, 1999

[54] TRAINING APPARATUS

[76] Inventor: Craig Askins, 2825 Windwood Dr., Unit 26, Ann Arbor, Mich. 48105

[21] Appl. No.: 08/965,884

[22] Filed: Nov. 7, 1997

[51] Int. Cl.[6] ..... A63B 23/02

[52] U.S. Cl. ..... 482/74; 482/148; 482/124

[58] Field of Search ..... 482/51, 74, 124, 482/122, 128, 148; 434/247, 255

[56] References Cited

U.S. PATENT DOCUMENTS

| | | | |
|---|---|---|---|
| 3,519,269 | 7/1970 | Howlett et al. . | |
| 3,819,177 | 6/1974 | Spiro . | |
| 3,972,238 | 8/1976 | Thatcher . | |
| 4,325,548 | 4/1982 | Piccini . | |
| 5,024,443 | 6/1991 | Bellagamba . | |
| 5,217,186 | 6/1993 | Stewart et al. . | |
| 5,226,820 | 7/1993 | Pearson . | |
| 5,234,392 | 8/1993 | Clark | 482/51 |
| 5,460,589 | 10/1995 | Dunn . | |
| 5,472,394 | 12/1995 | Michaelson . | |
| 5,490,826 | 2/1996 | Rose . | |
| 5,512,029 | 4/1996 | Barnard et al. . | |

OTHER PUBLICATIONS

Perform Better! Your Guide to Functional Training & Rehabilitation, 1997 Catalog, 1996 M–F Athletic Company, Cranston, RI, p. 21.

Power Systems, Product Catalog Fall/Winter 1997, Knoxville, TN, p. 5.

Power Systems, Product Catalog Fall/Winter 1998, Knoxville, TN, pp. 3 and 5.

*Primary Examiner*—Jerome Donnelly
*Attorney, Agent, or Firm*—Fulbright & Jaworski LLP

[57] ABSTRACT

An exercise apparatus and method for training athletes or rehabilitating disabled or injured individuals. The device is used to assist users with training muscle fibers that are difficult to train. This device will allow a coach to assist the user with the development of muscles. A user portion (14) of the belt (60) is used to harness a user during an exercise. A controller portion (12) may be connected to the user portion (14) for applying and controlling resistance during the exercise. The training apparatus is used to apply the overload (i.e., additional resistance) at single points or in short phases in order to maintain specificity of the learned action; not to train similar but alternate patterns of action that would not be used by the neuromuscular system when executing the original action. In addition, the apparatus allows the controller the option of assisting the user with the training by choosing whether to pull a releasing handle.

30 Claims, 25 Drawing Sheets

TRAINING APPARATUS

BACKGROUND OF THE INVENTION

1. Field of Invention

This invention relates to a training apparatus used as a means for training athletes. Additionally, this invention relates to a muscle conditioning apparatus to be used for the rehabilitation of disabled or injured individuals.

2. Background Art

Over the years, training apparatus have been developed which involve tethering an athlete to a stationary object. An early example is described in U.S. Pat. No. 3,972,238 issued to Thatcher. In this patent, the athlete, wearing an upper body harness connected by a tether to a shock absorbing spring assembly, is fastened to either a fixed pole, a weighted bag, or another athlete. As the athlete rushes away from the pole, he is forcibly stopped by the maximum expansion limit of the spring assembly. The upper body harness, described in U.S. Pat. No. 3,972,238, is designed to impact or strike the athlete in what is considered the best position to knock an opponent down. The force is imparted at the chest or breast bone area, above his center of gravity. The device is also used with a release tether to develop breakaway balance skills and prevent the athlete from relying on the opponent's counter-force to keep the athlete from falling.

Another known tethering example is the kicking device of Piccini disclosed in U.S. Pat. No. 4,325,548. In the Piccini device, a restraining element is applied to the kicking foot of a player which, in turn, is secured to a strap anchored at a remote position. The player, positioning the pivot foot firmly on the ground, exercises the kicking leg by bending the knee with toes pointing downward, then moving the knee to a position where the leg is substantially straight. This device discloses an elastic band, for encircling the ankle of a player, having an elastomeric strap secured at the rear portion of the band adjacent the achilles heel of the player, for anchoring the strap at a position remote from the point where it is attached to the ankle band. Desirably, a clip with a ring is secured to the rear portion of the strap so that the strap can be attached to a tree, post, or other anchor position adjacent to the ground or floor.

U.S. Pat. No. 3,819,177, issued to Spiro, discloses an elastic exercise belt which comprises a length of elastic webbing that uses VELCRO or hook and loop fasteners to provide a tensional force during isometric exercises

SUMMARY OF THE INVENTION

The present invention provides an athletic device for training sprinters, runners, jumpers, or other athletes. In addition, the training apparatus may provide a rehabilitation device for rehabilitating disabled or injured individuals.

An objective of the invention is to provide surmountable resistance at a single point or through a short phase of an athletic action or rehabilitation exercise for users. The training method and resultant training effect is intended to develop and enhance vertical or horizontal explosive action. This includes but is not limited to track starts, horizontal directional maneuvers and vertical jumping maneuvers in football, tennis, lacrosse, basketball, baseball, field hockey, volleyball, high jump, swimming and soccer.

It is an equally important objective of this invention that the surmountable resistance can be applied at any one of many points or at any one of many short phases throughout the action or exercise.

An athlete can perform an action according to this invention and encounter greater resistance than normally encountered while performing the action at optimal performance level.

Another objective of the invention is to provide resistance to trained users who are running from a starter's block. The training apparatus of the invention can be used to provide resistance during different points of the start by adjusting the slack in the belt. If the resistance strap is taut, the sprinter will immediately have resistance out of the starter's block. With little slack in the resistance strap, the runner will feel the resistance in the first step out of the block. If there is a large loop left between the controller (e.g., coach or monitor) and the runner, the runner will feel the resistance, for example, on the second step out of the block. This method of providing resistance at different points due to the slack in the belt may be applied to other sports or to rehabilitation exercises.

Another object of the invention is to provide resistance training to jumpers for horizontal and vertical jumps.

Another object of the invention is to provide resistance training for running backwards.

Another object of the invention is to provide lateral training for athletes.

Another object of the invention is to provide monitored, controlled resistance training.

Another object of the invention is to provide muscle rehabilitation.

Another objective of the invention is to impose a training method that will cause the athlete's muscular system to adapt by increasing the size and strength of the specific muscle fibers used to accomplish an action.

Another objective of the invention is to impose a training method that will teach n the athlete's energy system and neuromuscular system to anticipate an "overloaded" action and respond to the anticipated overload so the stronger muscle fibers and the extra muscle fibers contract, although they may do so without encountering the greater resistance, which will yield greater force and/or speed in the intended action.

DESCRIPTION OF THE PREFERRED EMBODIMENT

Figure 1:
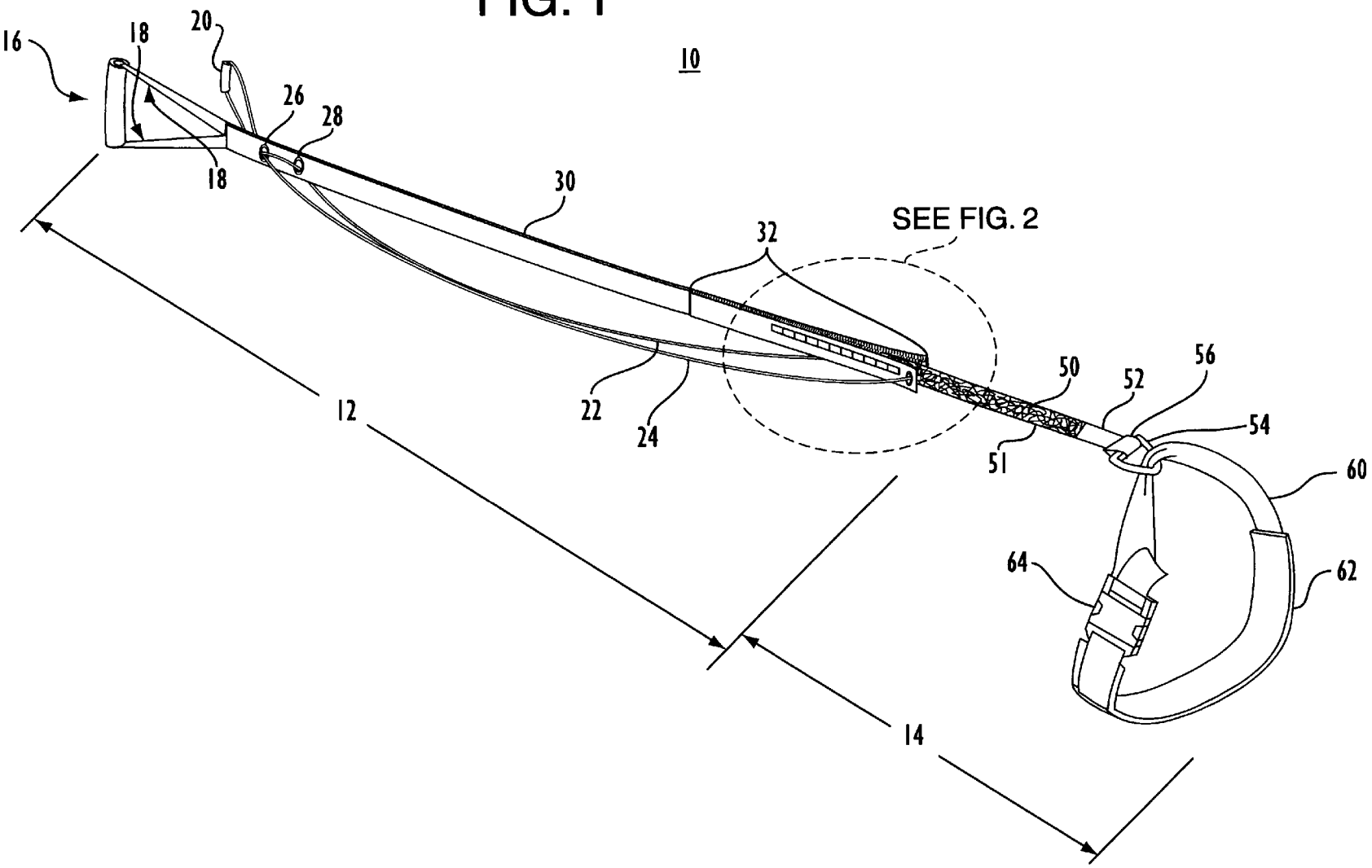
FIG. 1 shows the training apparatus.

FIG. 1 depicts the training device (10) which may be described in two parts: the user portion (14) and the controller portion (12). The user portion (14) can be physically attached to a user (72) and may include a belt with a connection means to a tether strap (e.g., a long durable strip with an attaching means for attachment to the controller portion). The controller portion is composed of a durable restraining strap which splits at one end into two separate straps with a means for attaching to the user portion.

Figure 3:
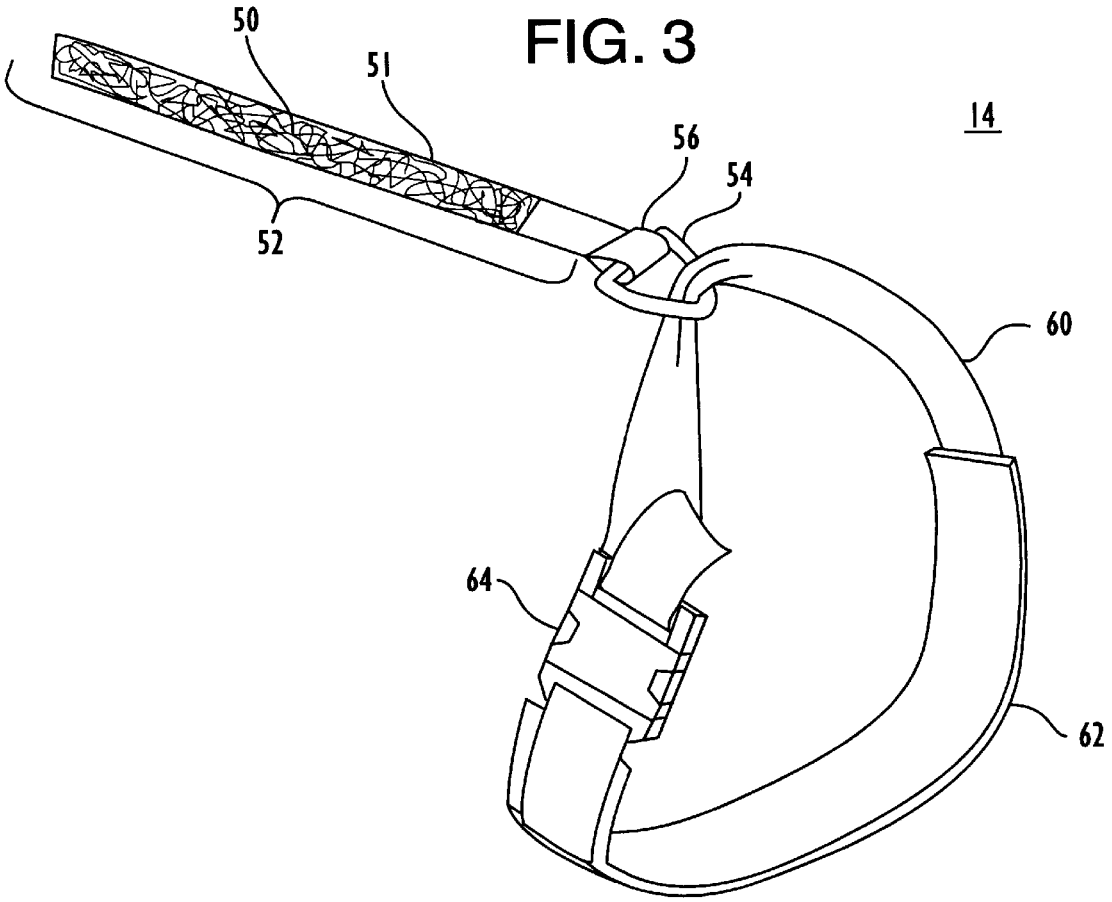
FIG. 3 shows the user portion of the training apparatus.

FIG. 3 shows a perspective view of the user portion of the training device. The user portion has a belt (60) made of a durable material (e.g., nylon, polyprowebbing, fabric, elastic, etc.) that encircles the waist of the user (72) (e.g., athlete or patient). The belt (60) may be secured by a variety of attaching means (64) (e.g., VELCRO or hook and loop fasteners, buckles, snaps, etc.). Located on the back of the belt is a connection means (54) (e.g., metal ring, nylon ring, loop, etc.). The connection means (54) connects the belt to a tether strap (52) which may be made of a long, durable material strip (e.g., nylon, fabric, elastic, etc.) that has an attaching means (50, 51) (e.g., VELCRO or hook and loop fasteners, snaps, etc.) on both sides.

Figure 4:
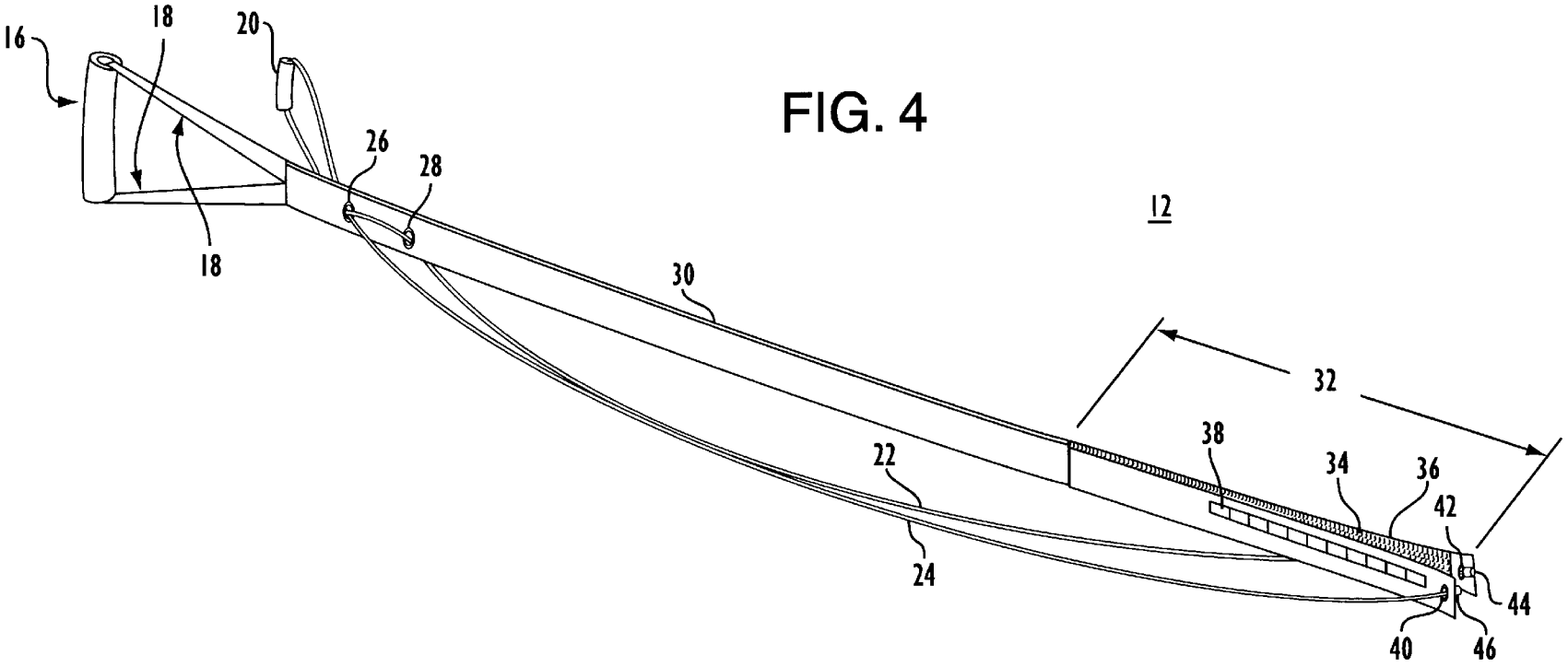
FIG. 4 shows the controller portion of the training apparatus.

FIG. 4 shows the controller portion (12) of the training device (10) which is a "Y" shaped strap with a first end (30) and second end (32). The first end (30) is connected to the anchoring handle (18). The anchoring handle may have a padded cushion (16) for the controller's comfort. The second end (32) of the resistance strap is split into two separate straps that each have an attaching means (34, 36) (e.g., velcro located on the interior side of the straps) for connection to the tether strap (52). The outer sides of the separate straps (48, 49) may have a gauged or calibrated ruler (38) for allowing the user (72) (e.g., runner or patient) and the monitor (70) (e.g., coach, controller or physician) to determine the amount of resistance to be applied during an exercise. The amount of applied resistance is determined by the length of tether strap (52) inserted and fastened between the separate straps (48, 49). At the end of each separate strap (48, 49), opposite the split, is a small hole (40, 42) (e.g., metal eyelet, grommet, etc,). Each hole is threaded with a release cord (22, 24) that extends to the first end of the resistance strap where the cords are threaded through two horizontally positioned holes (26, 28) (e.g., metal eyelet, grommet, etc,). The cords terminate into a releasing handle (20). The releasing handle may have a means for comforting the controller's hand (e.g., padding, plastic tubing, etc.)

Figure 2:
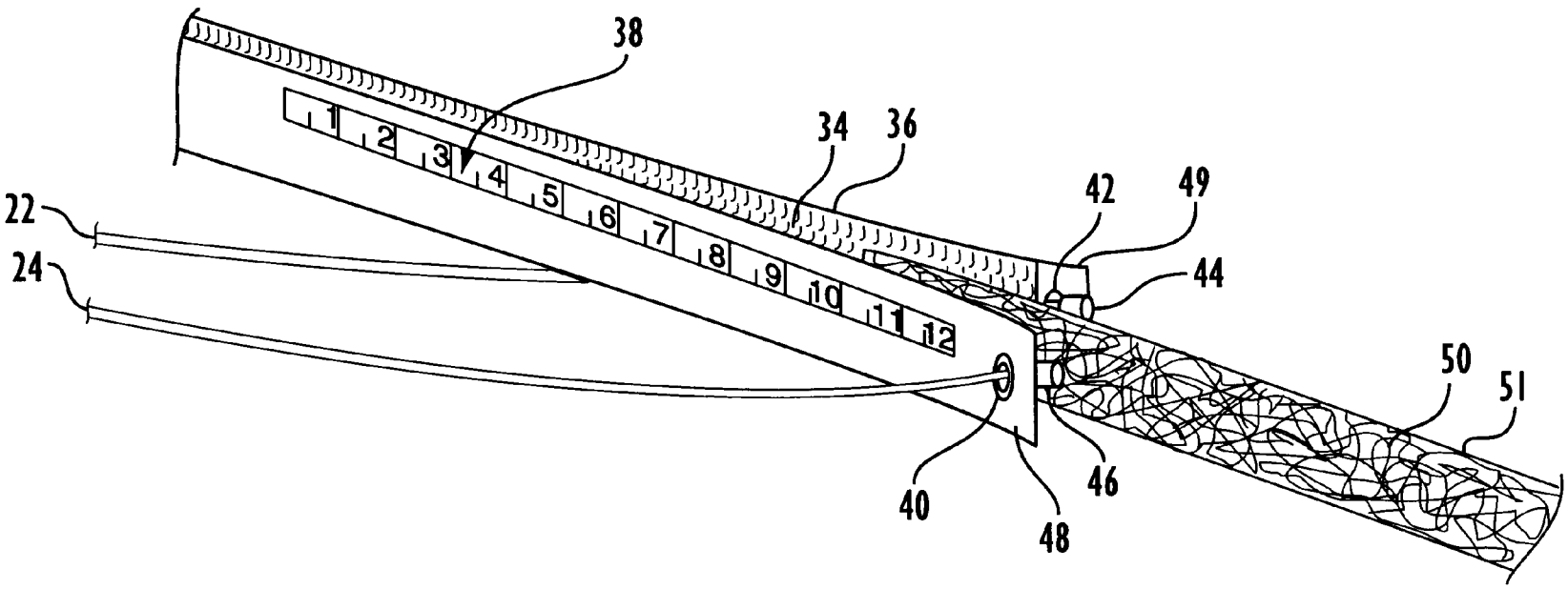
FIG. 2 shows a closeup of the connection between the controller portion and the user portion.

FIG. 1 shows how the resistance strap and belt with the tether strap are connected together for an exercise session. FIG. 2 shows a close up of the gauged or calibrated ruler (38) used for determining the amount of resistance applied during an exercise.

Figure 5:
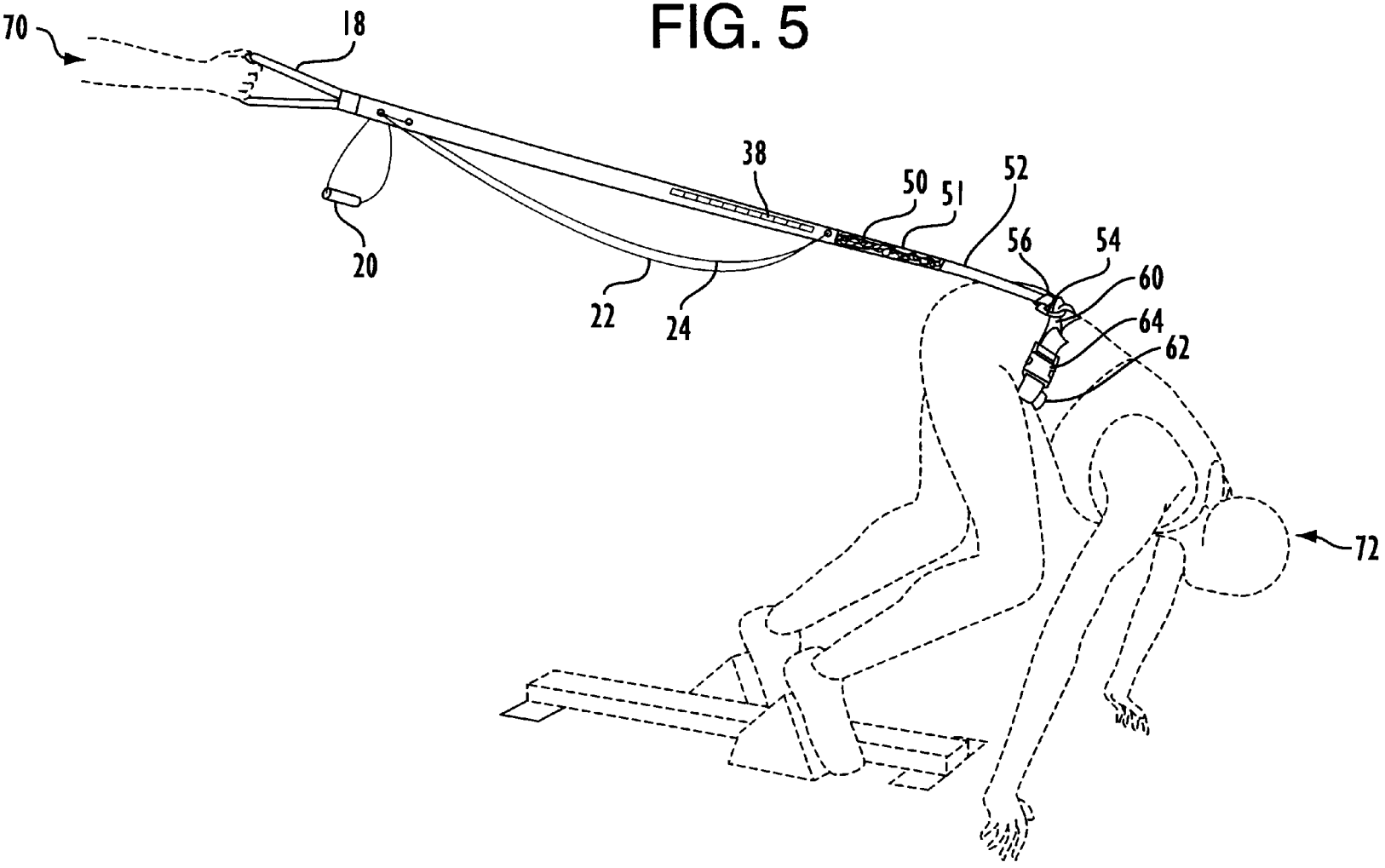
FIG. 5 shows the first stage of the "Pop" method.
Figure 6:
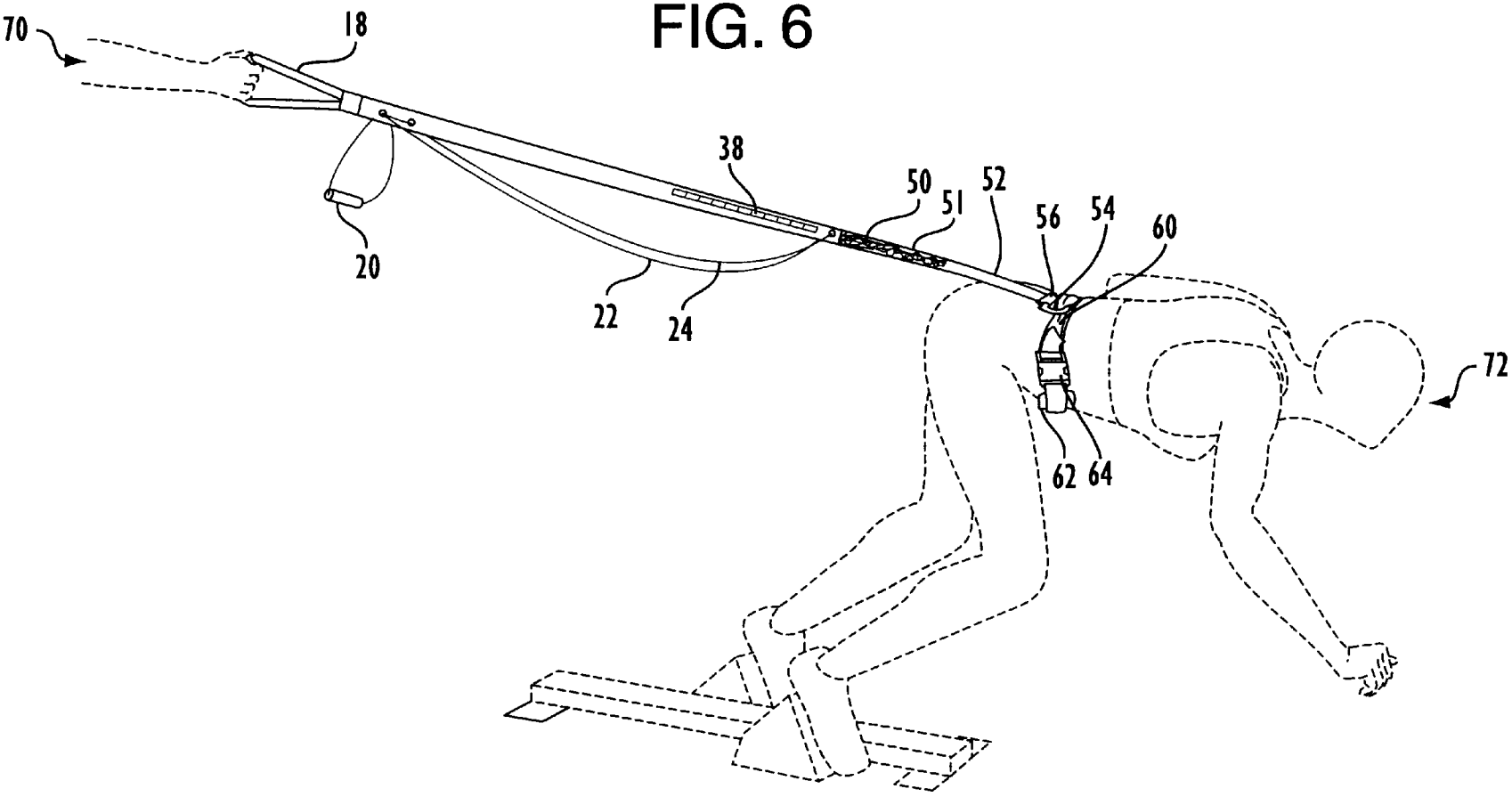
FIG. 6 shows the second stage of the "Pop" method.
Figure 7:
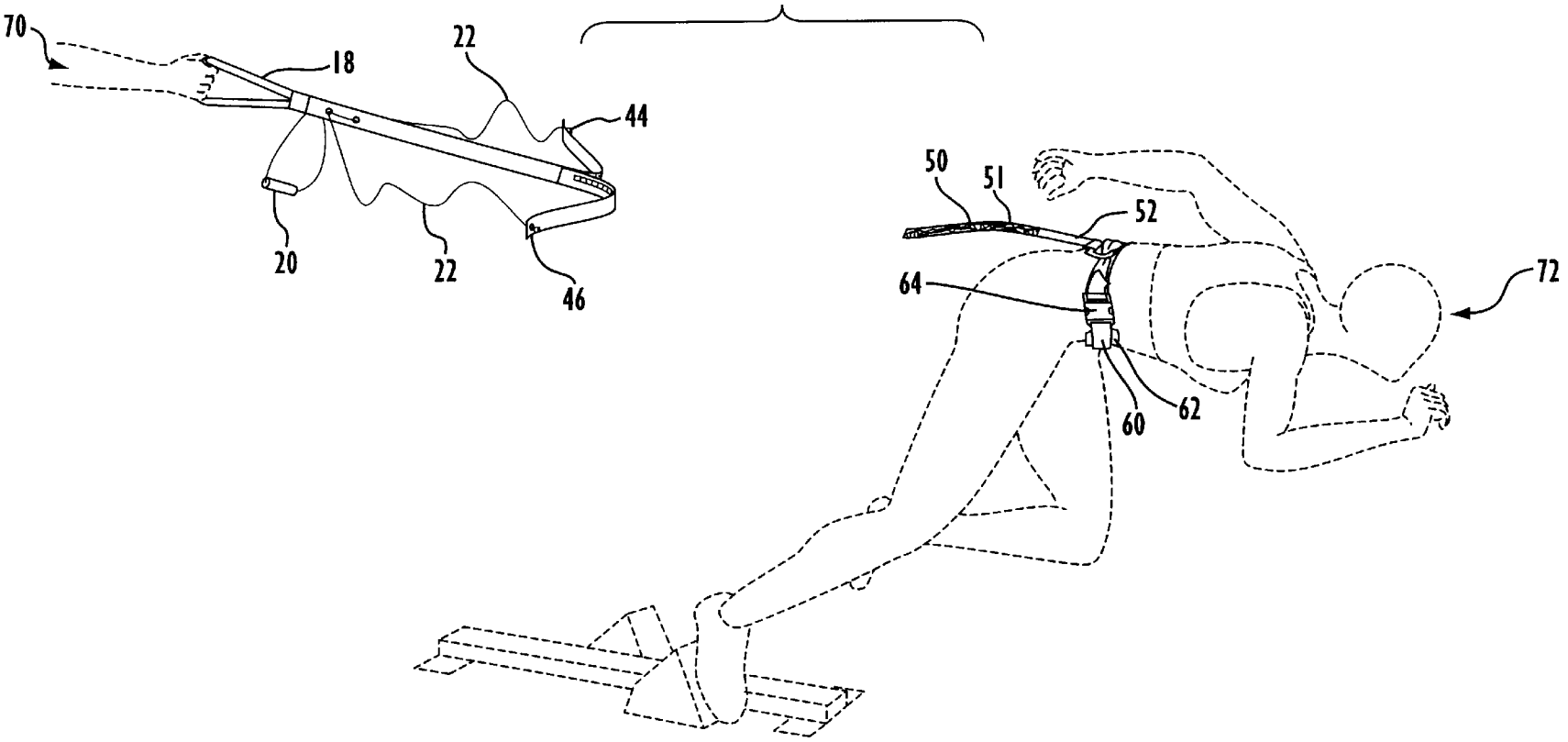
FIG. 7 shows the final stage of the "Pop" method.

The training apparatus may be used in a variety of manners. In a preferred embodiment, the runner uses his own speed and force to break the belt's resistance. For this embodiment, the controller calibrates the belt within a range that can be broken by the athlete's own power. For purposes of description, this method will be called the "Pop" method and is depicted in FIGS. 5–7. The "Pop" method occurs whenever the controller opts not to assist the athlete's effort to break the belt's resistance. The resistance is overcome solely by the athlete and is overcome at one particular point in the exercise or action. FIG. 4 shows the controller (70) anchoring the athlete (72) for the training exercise. The training apparatus is pulled tautly so the runner will encounter resistance immediately out of the starting block. When the runner begins his start, shown in FIG. 6, he must overcome the resistance of the attaching means (e.g., VELCRO or hook and loop fasteners, snaps, etc.). FIG. 7 shows how the resistance strap falls free from the tether strap once the resistance has been overcome by the user.

Figure 8:
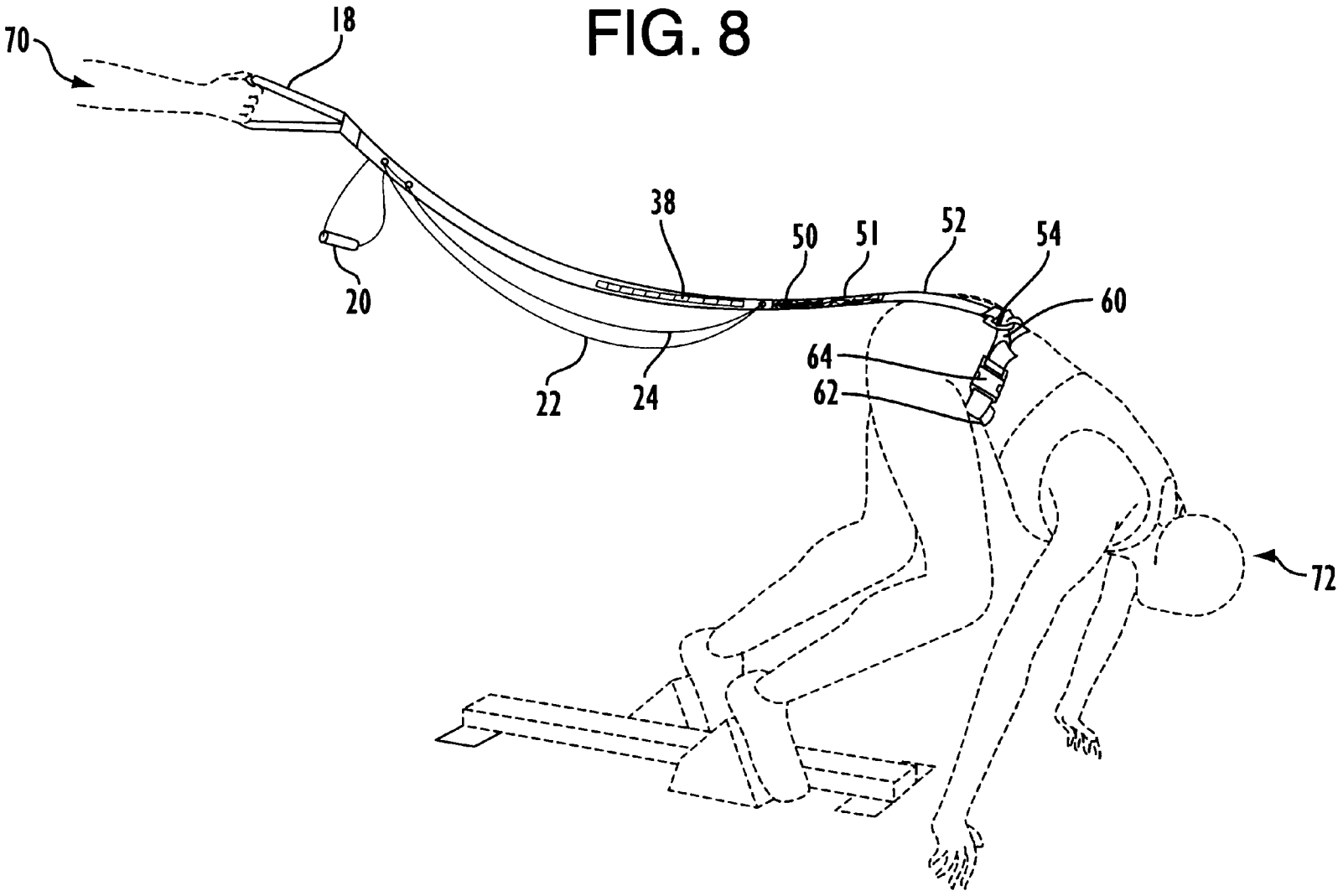
FIG. 8 shows the amount of slack needed to receive the resistance of the first step out of the block.
Figure 9:
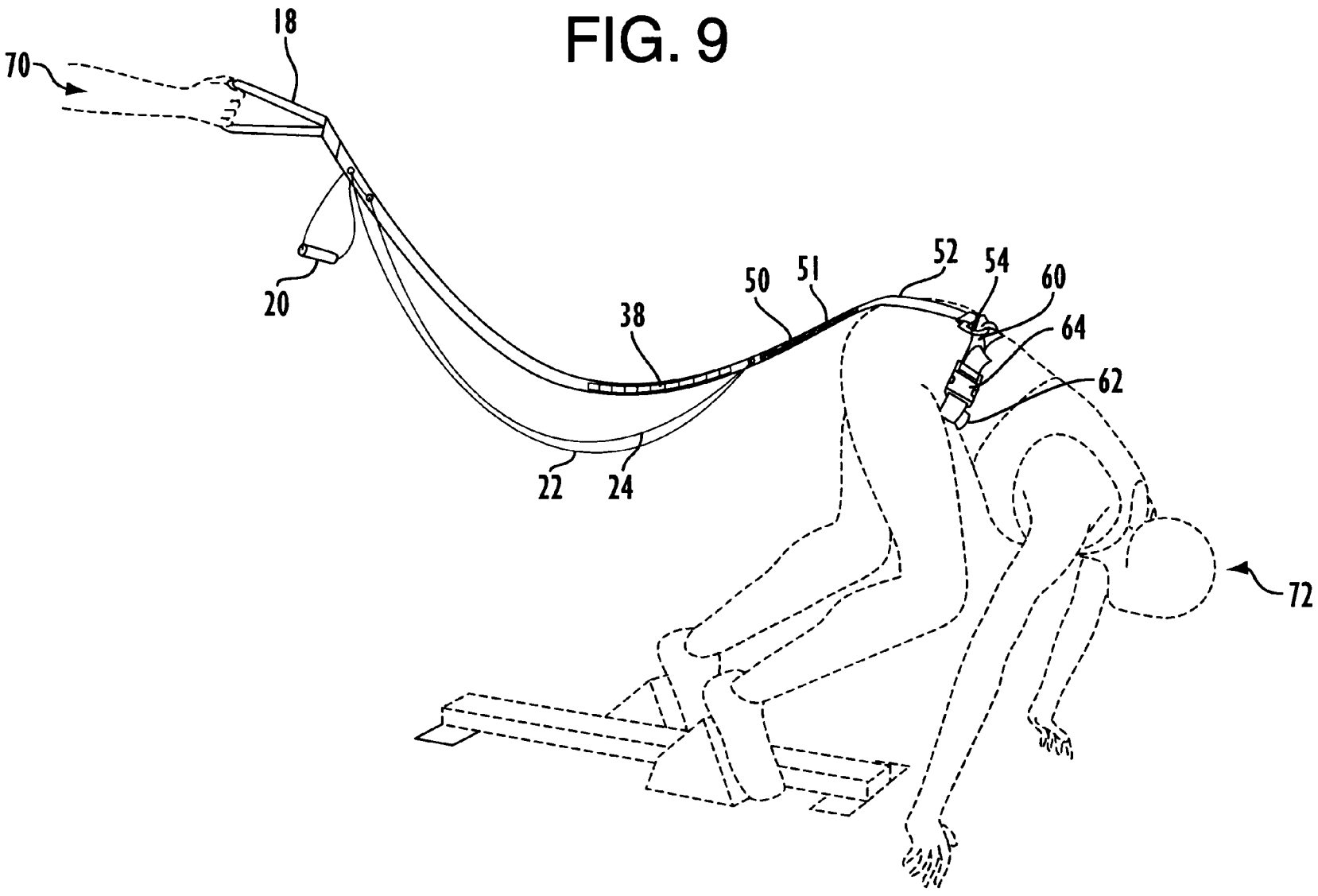
FIG. 9 shows the amount of slack needed to receive the resistance of the second step out of the block.

FIGS. 8 and 9 display different levels of slack that the monitor can use to determine at which point in the start the runner encounters the resistance. The medium amount of slack shown in FIG. 8 will allow the athlete to encounter resistance mid-way out of the starter's block. FIG. 9 shows a large amount of slack between the runner and the controller which allows the athlete to encounter resistance toward the end of the starting action.

Figure 10:
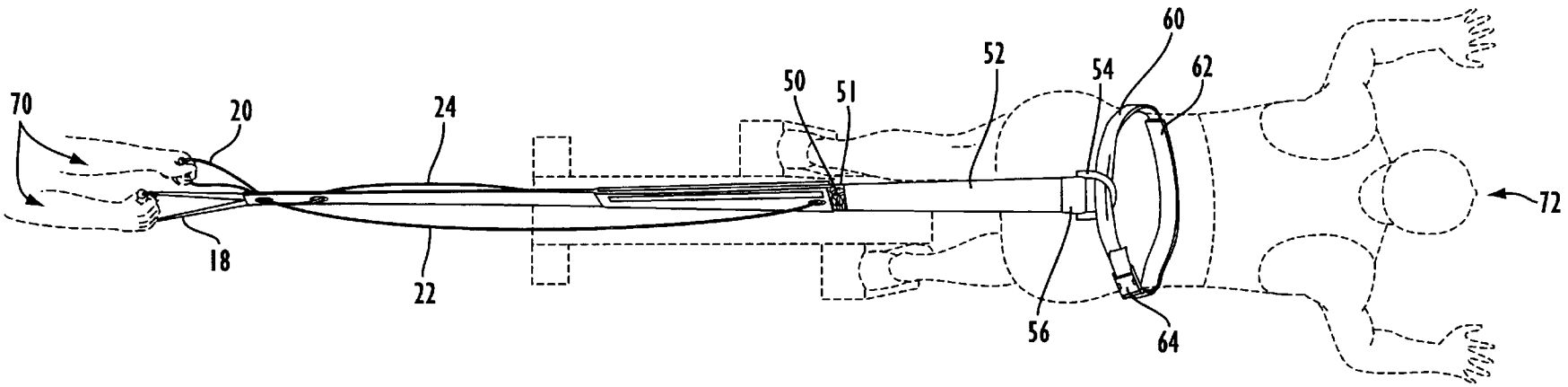
FIG. 10 shows the first stage of the "Rip" method.
Figure 11:
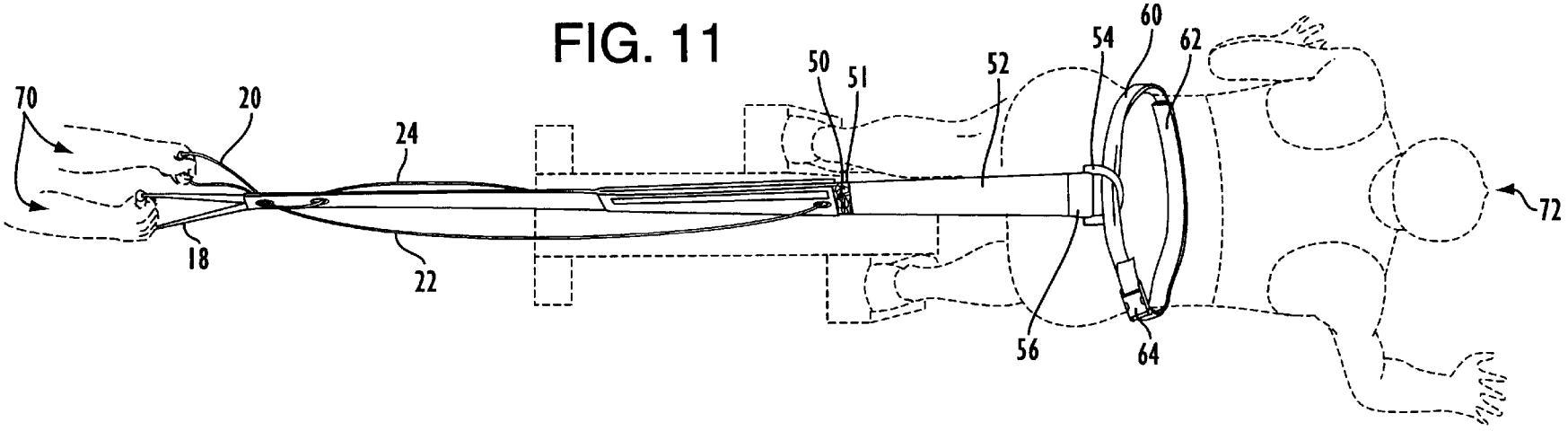
FIG. 11 shows the second stage of the "Rip" method.
Figure 12:
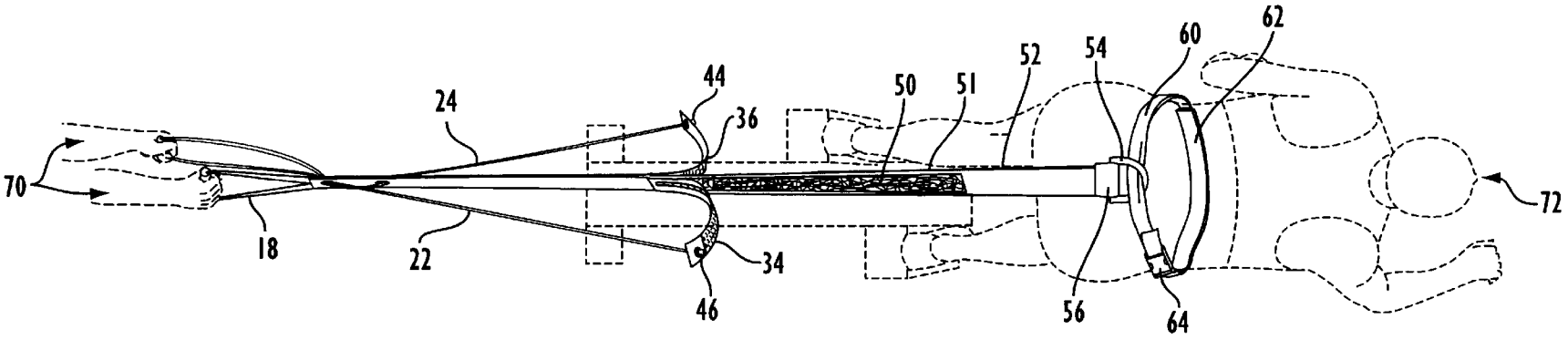
FIG. 12 shows the third stage of the "Rip" method.
Figure 13:
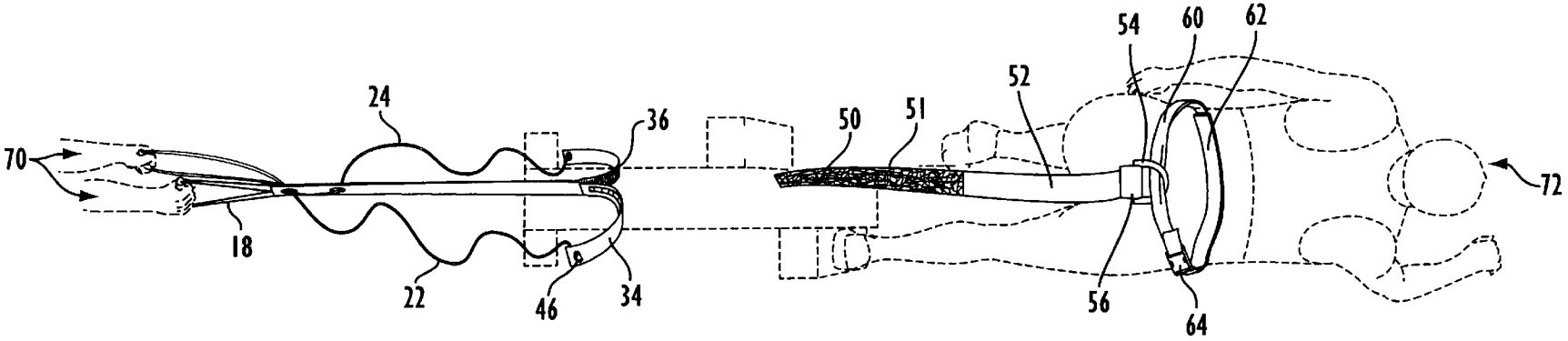
FIG. 13 shows the final stage of the "Rip" method.

In another preferred embodiment, the runner utilizes the controller's assistance in order to overcome the belt's resistance. For purposes of description, this method will be called the "Rip" method and is depicted in FIG. 10–13. The "Rip" method occurs whenever the controller opts to assist the athlete's effort to break the belt's resistance. The resistance is overcome by a coordinated combination of the controller starting the release of the separated straps (48, 49) via the release cords (22, 24) and the athlete finishing the release by pulling away the tether strap (52). This method results in a gradual release from the apparatus over a short phase of resistance (as opposed to a single point of resistance) in the action. This method may be better understood if compared to that of tearing a piece of cloth into two parts. Initially a greater amount of force is required to start tearing the cloth; once the rip has started, the cloth continues to tear with a lesser degree of required force (i.e., the controller assists with starting the tear, but the athlete is expected to finish the ripping on his own). FIG. 10 shows the controller (70) anchoring the athlete (72) for the exercise. When the runner begins his start, as shown in FIG. 11, the monitor pulls a resistance release handle (20) which starts the VELCRO or hook and loop fasteners ripping process. The resistance release handle (20) will pull the two cords (22, 24) that are attached to the ends of the two separate straps. The cord will not be pulled through the eyelet because the cords are anchored by lugs (44, 46). The monitor has the ability to control when the release occurs. Once the user has started running and the ripping process has begun, the user can overcome the remaining resistance himself, as shown in FIG. 12. FIG. 13 shows how the resistance strap falls free from the tether strap once the resistance has been overcome by the user.

In an alternate embodiment of the Rip method, the controller may use a full resistance release. In this method, the controller anchors the user during the exercise until he decides to release the user by pulling the resistance release handle to free the user. Unlike the previous method, the controller determines when the majority of the resistance is released.

Figure 14:
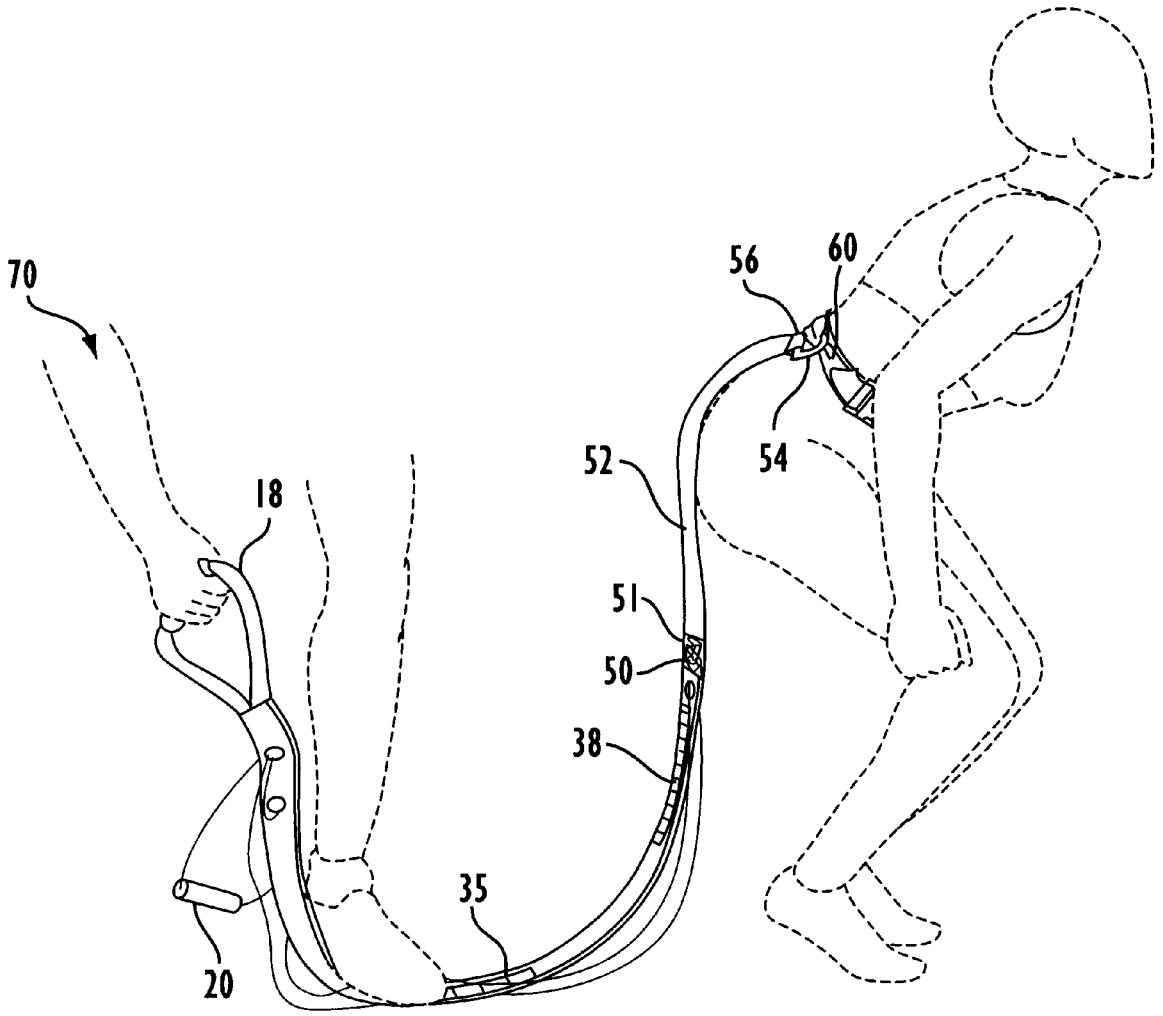
FIG. 14 shows the first stage of the training device used for vertical jump training.
Figure 15:
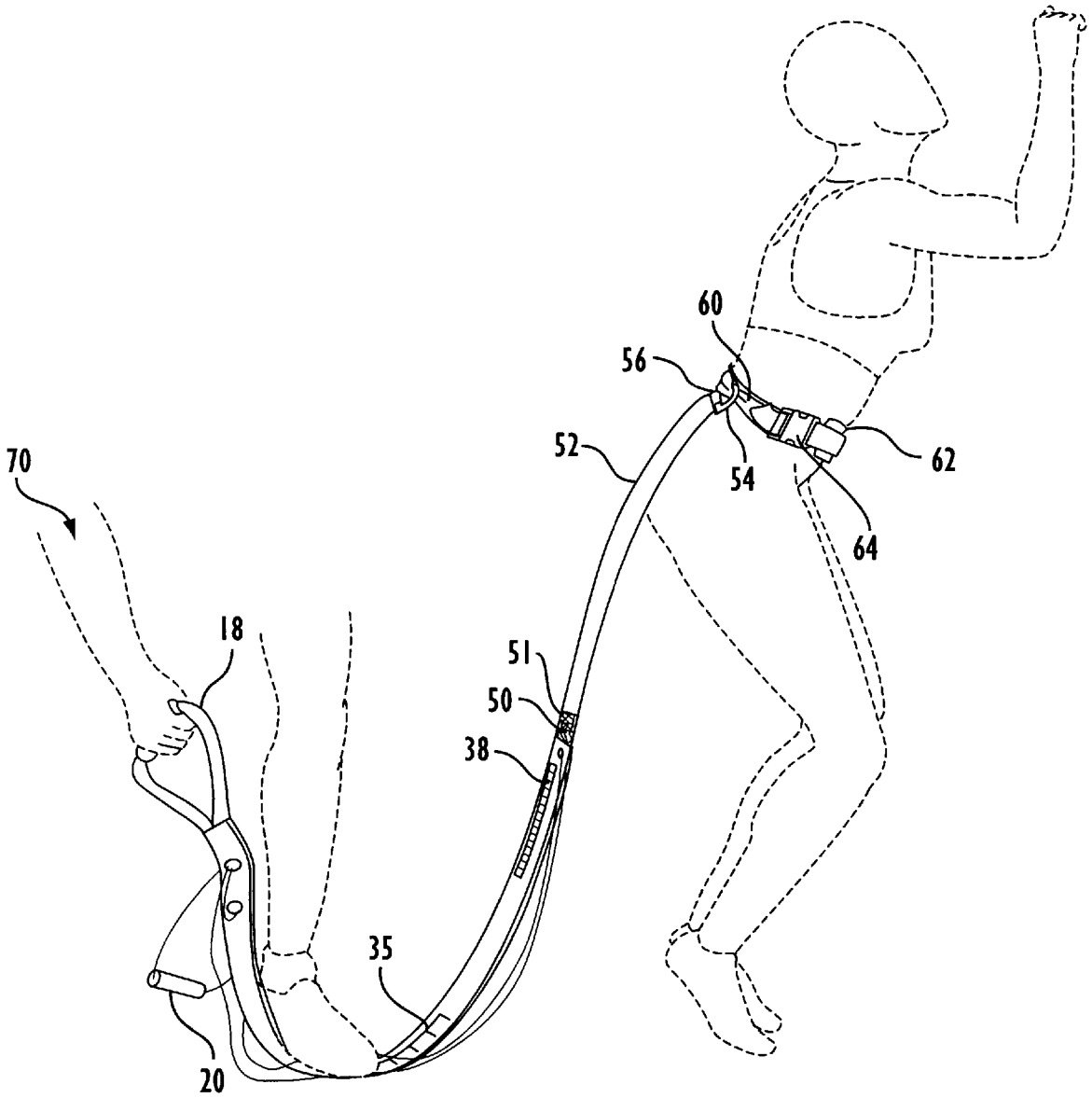
FIG. 15 shows the second stage of the training device used for vertical jump training.
Figure 16:
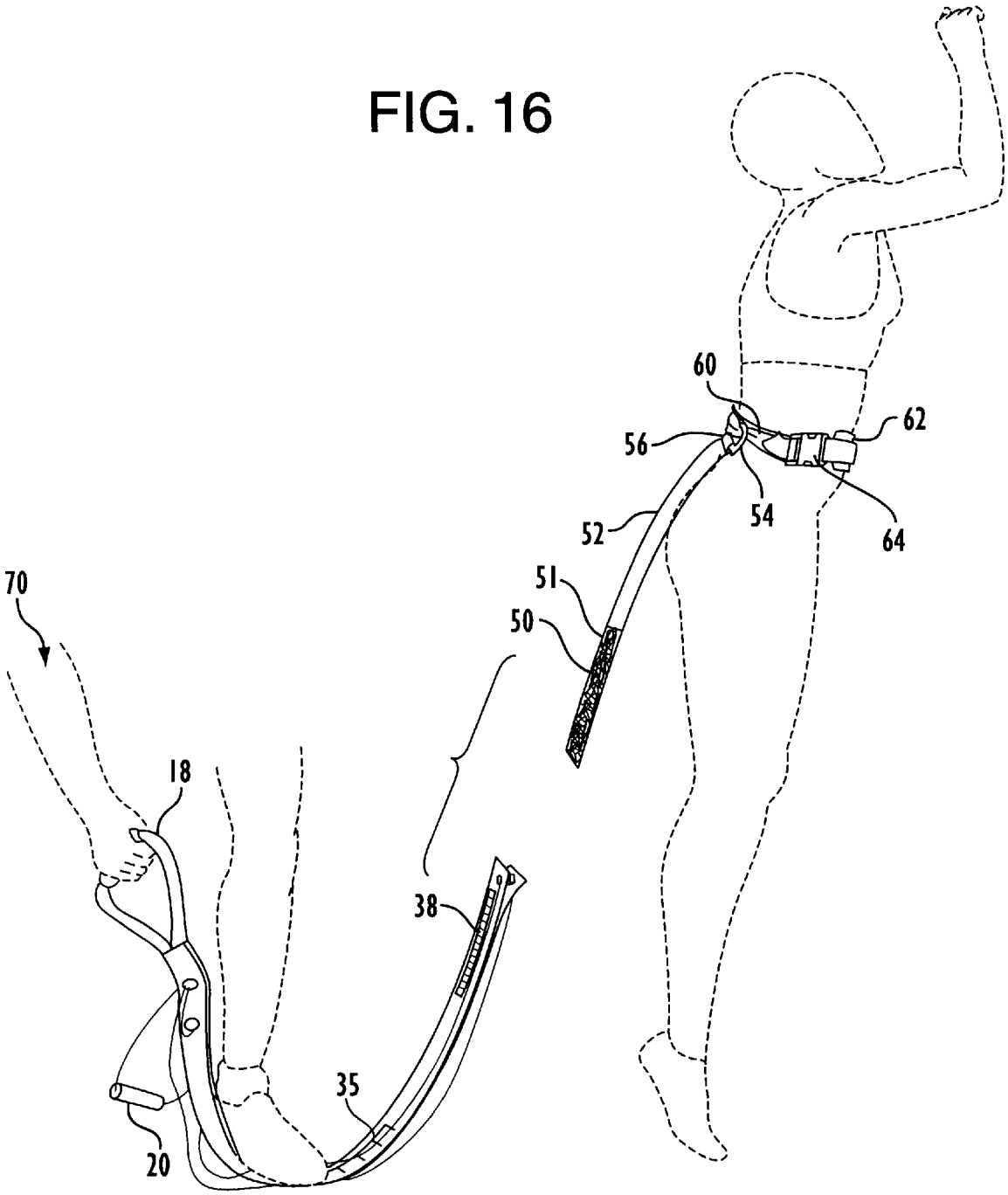
FIG. 16 shows the third stage of the training device used for vertical jump training.

In another preferred embodiment, the athlete uses his own power during vertical jumping to break the belt's resistance (FIGS. 14–16). For this embodiment, the controller calibrates the belt with a range that can be broken by the user's own power. The controller may then place his foot on the resistance strap (30) in order to apply resistance to the user during a vertical jump (FIG. 14). The controller can utilize the calibrated gauge or markings (31) located along the controller's portion (30) to determine at what point in the vertical jump the resistance is applied. This process is the "Pop" method being applied to the muscles used in vertical jumping.

Figure 17:
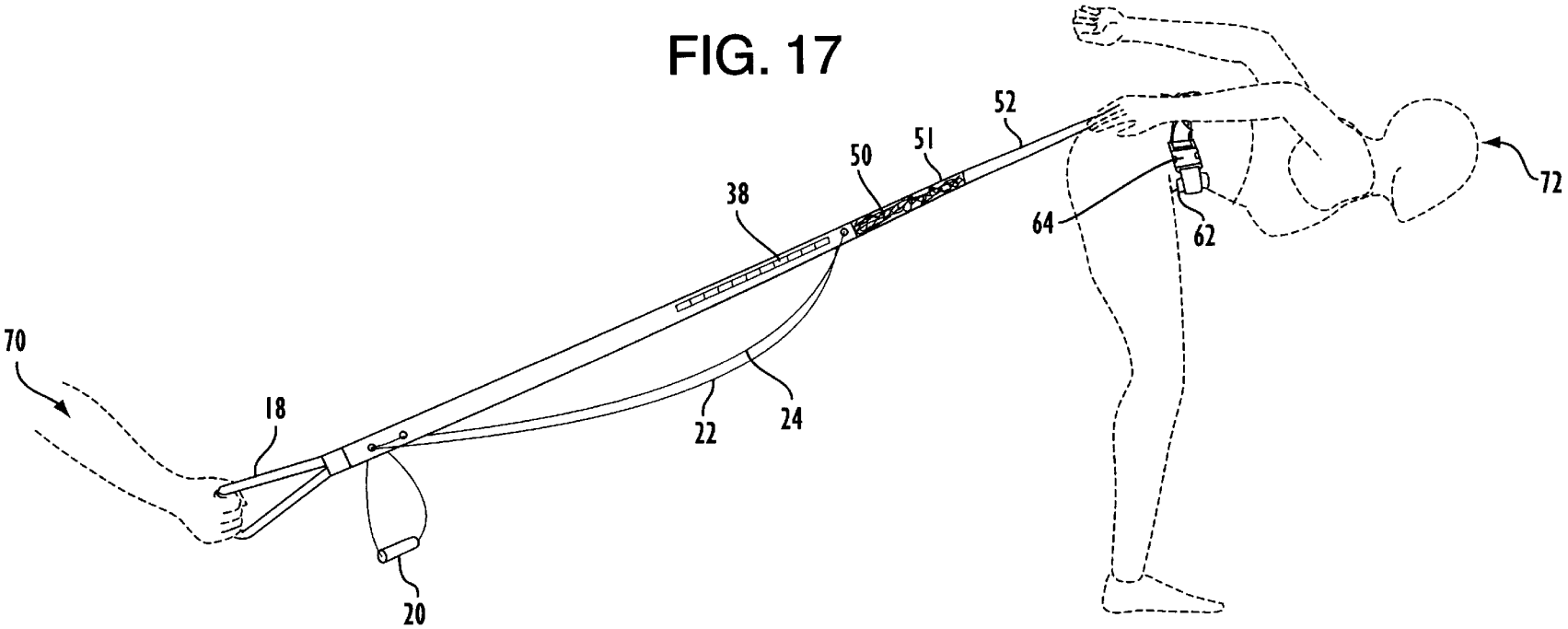
FIG. 17 shows the first stage of the training device used for horizontal jump training.
Figure 18:
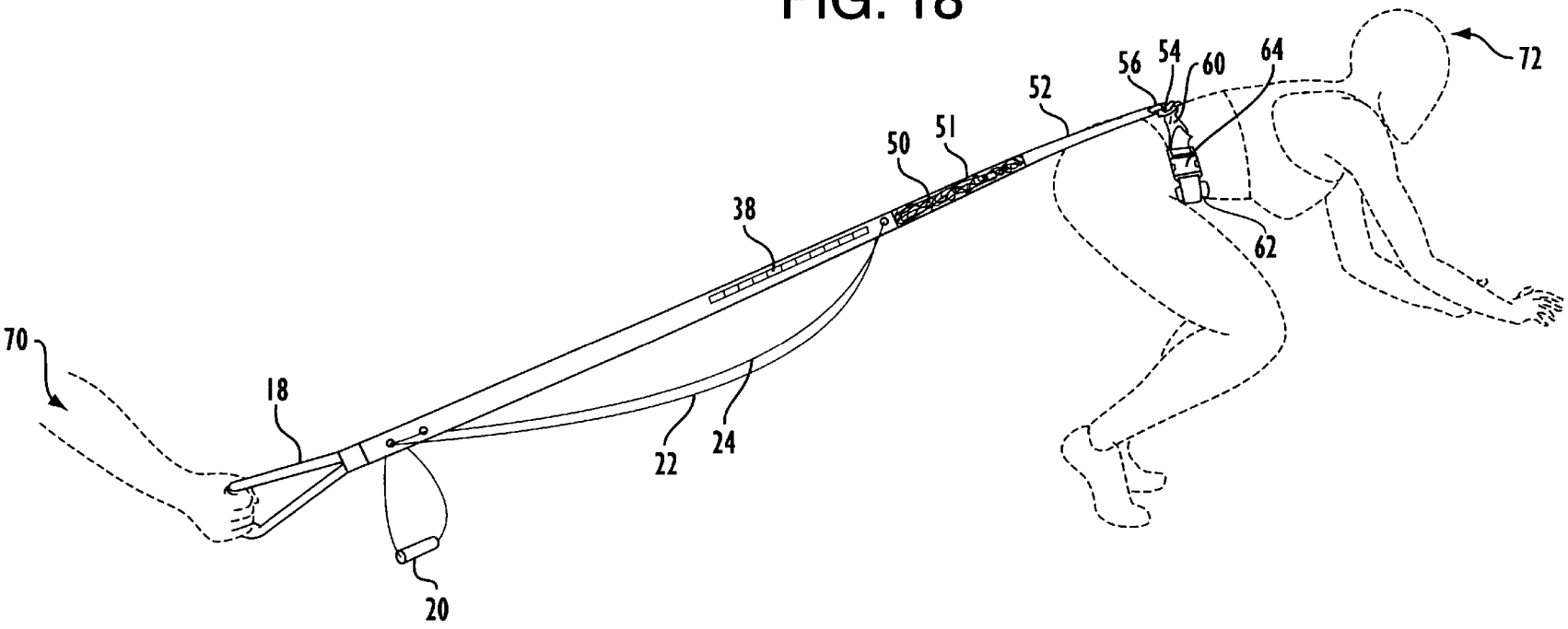
FIG. 18 shows the second stage of the training device used for horizontal jump training.
Figure 19:
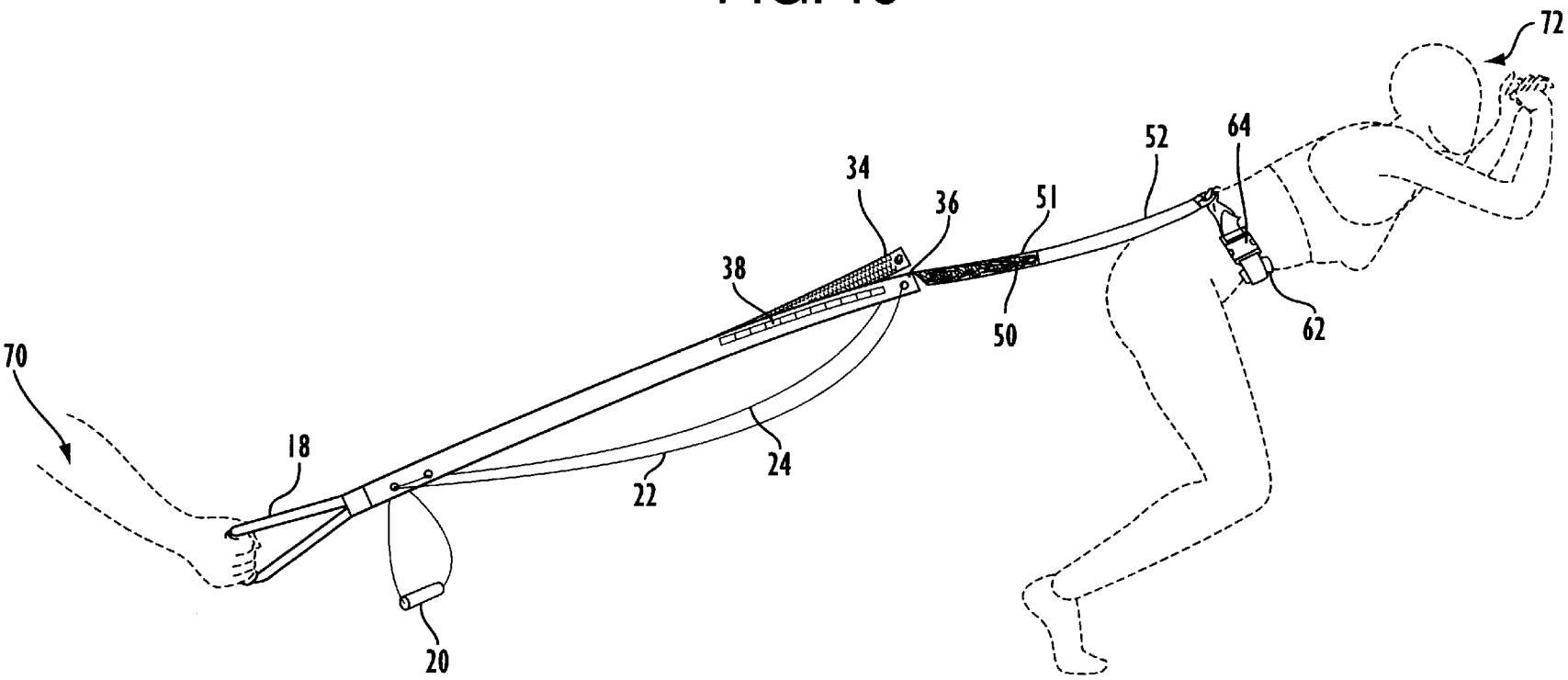
FIG. 19 shows the third stage of the training device used for horizontal jump training.
Figure 20:
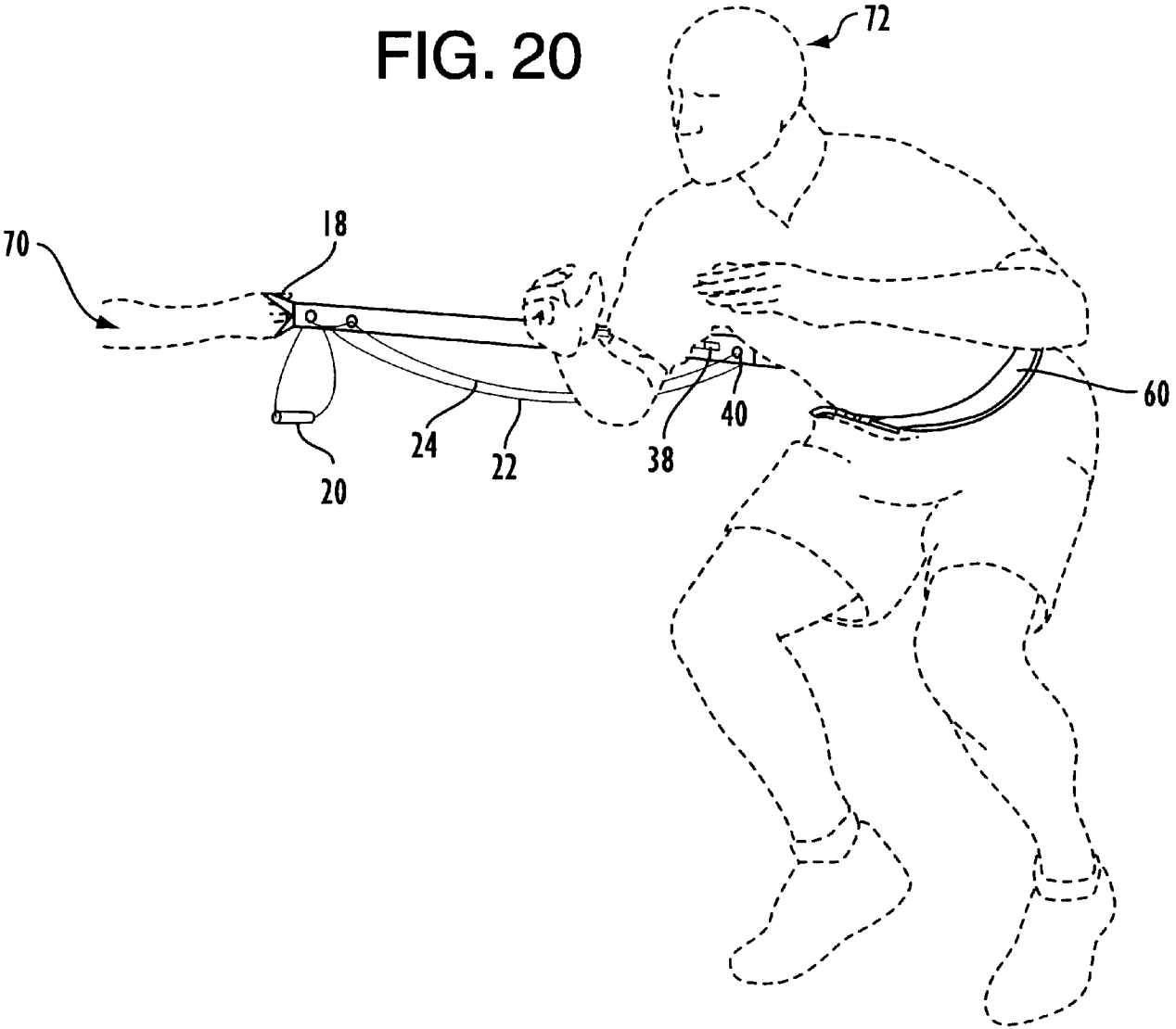
FIG. 20 shows the first stage of the training device used for lateral training.
Figure 21:
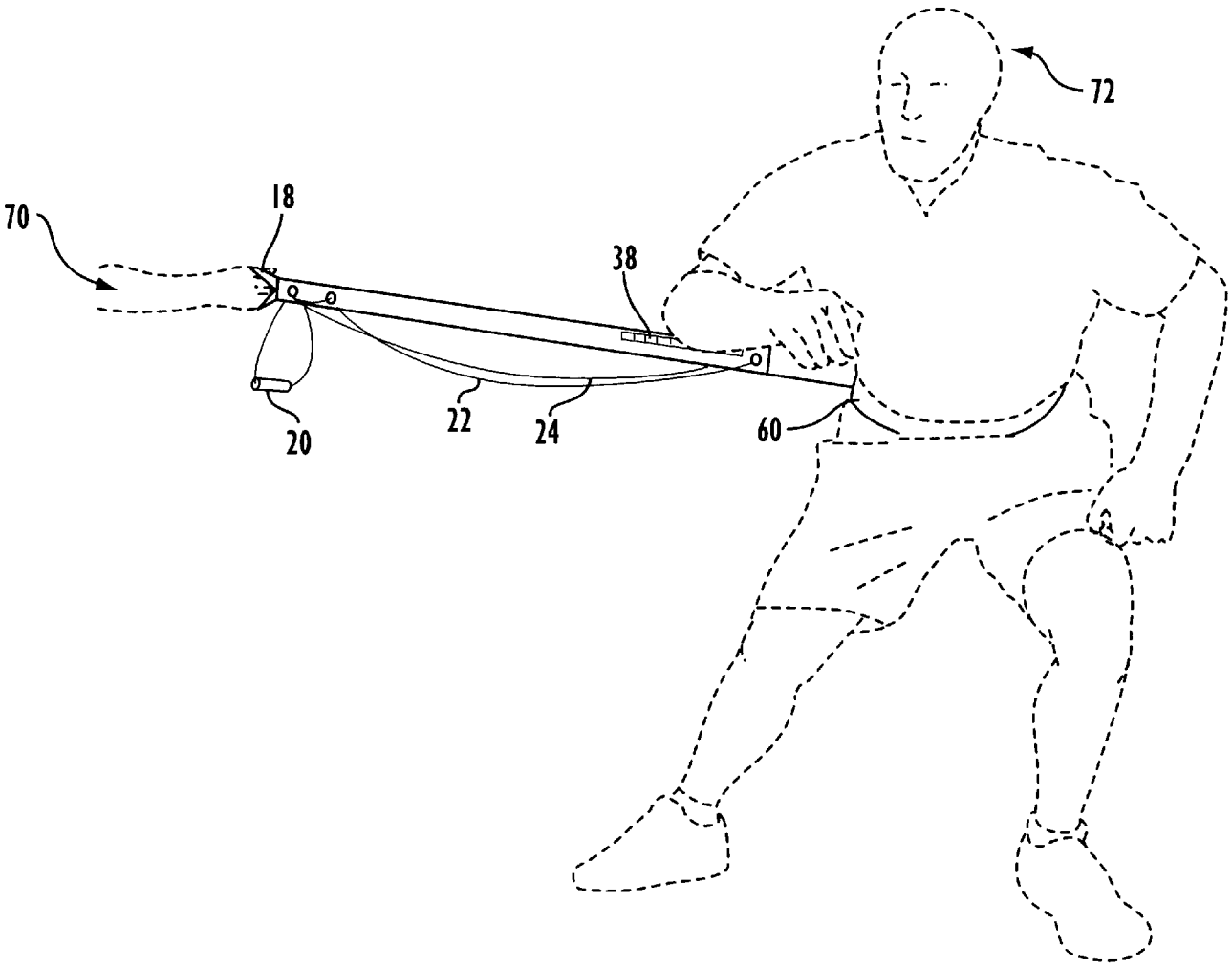
FIG. 21 shows the second stage of the training device used for lateral training.
Figure 22:
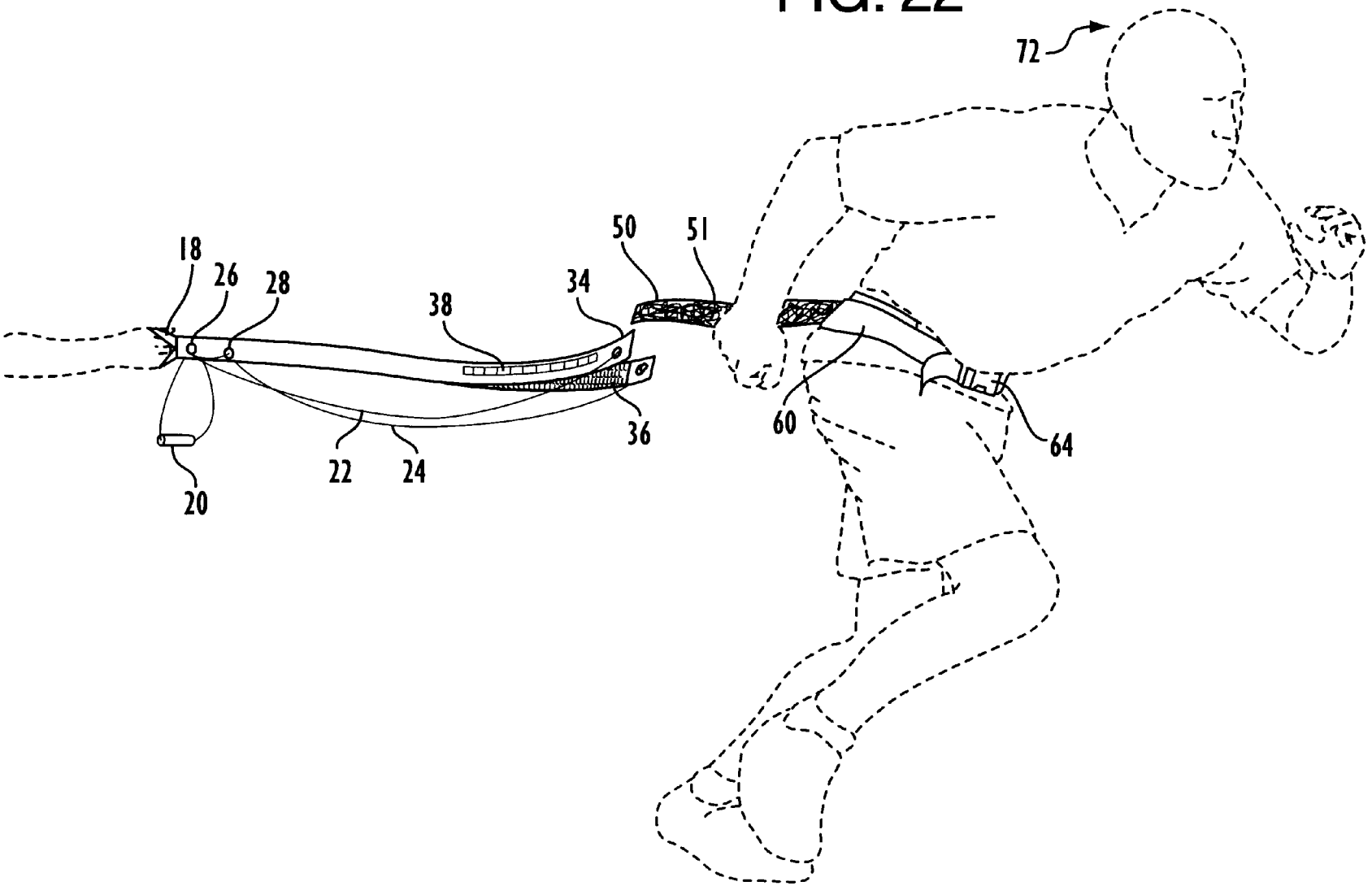
FIG. 22 shows the third stage of the training device used for lateral training.
Figure 23:
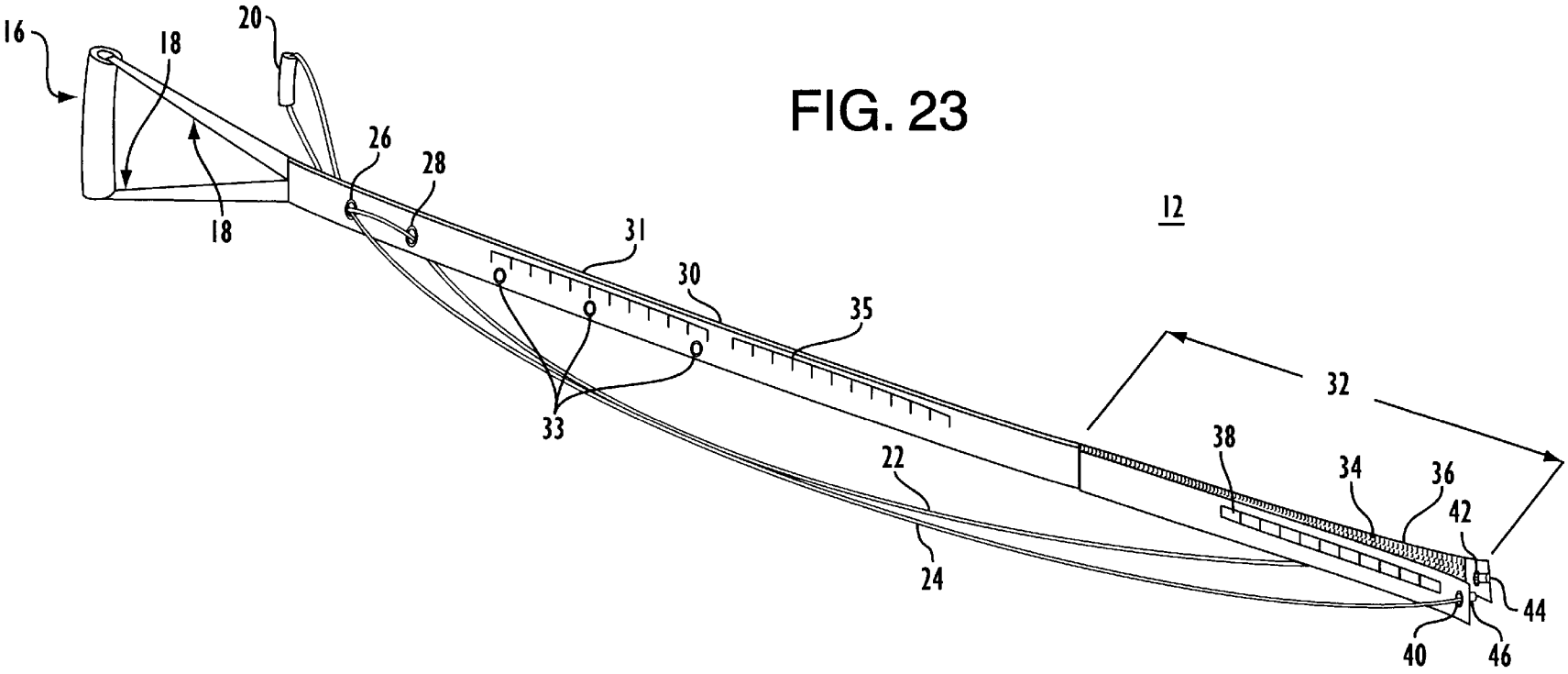
FIG. 23 shows another embodiment of the training apparatus.

In another preferred embodiment, the athlete uses his own power during horizonal jumping to break the belt's resistance (FIGS. 17–19). For this embodiment, the controller calibrates the belt with a range that can be broken by the user's own power (e.g., a range from one to five inches). The controller may then hold the resistance strap at a downward angle (FIG. 17) in order to apply resistance to the user during a horizonal jump.

In another preferred embodiment, the athlete can condition the muscles used in lateral running maneuvers (FIGS. 17–19). For this embodiment, either the "Rip" or "Pop" method can be used.

In another preferred embodiment, the athlete can condition the muscles used in running backwards (not shown). For this embodiment, either the "Rip" or "Pop" method can be used, however, unlike the previous embodiments, the user faces the controller during the exercise.

The training apparatus is not only effective but it is inexpensive and practical. The training apparatus may be used with or without a coach or trainer (i.e., the controller portion of the device may be mounted to a stationary pole and the resistance may be set to an amount that the user can overcome with his own power).

Figure 24:
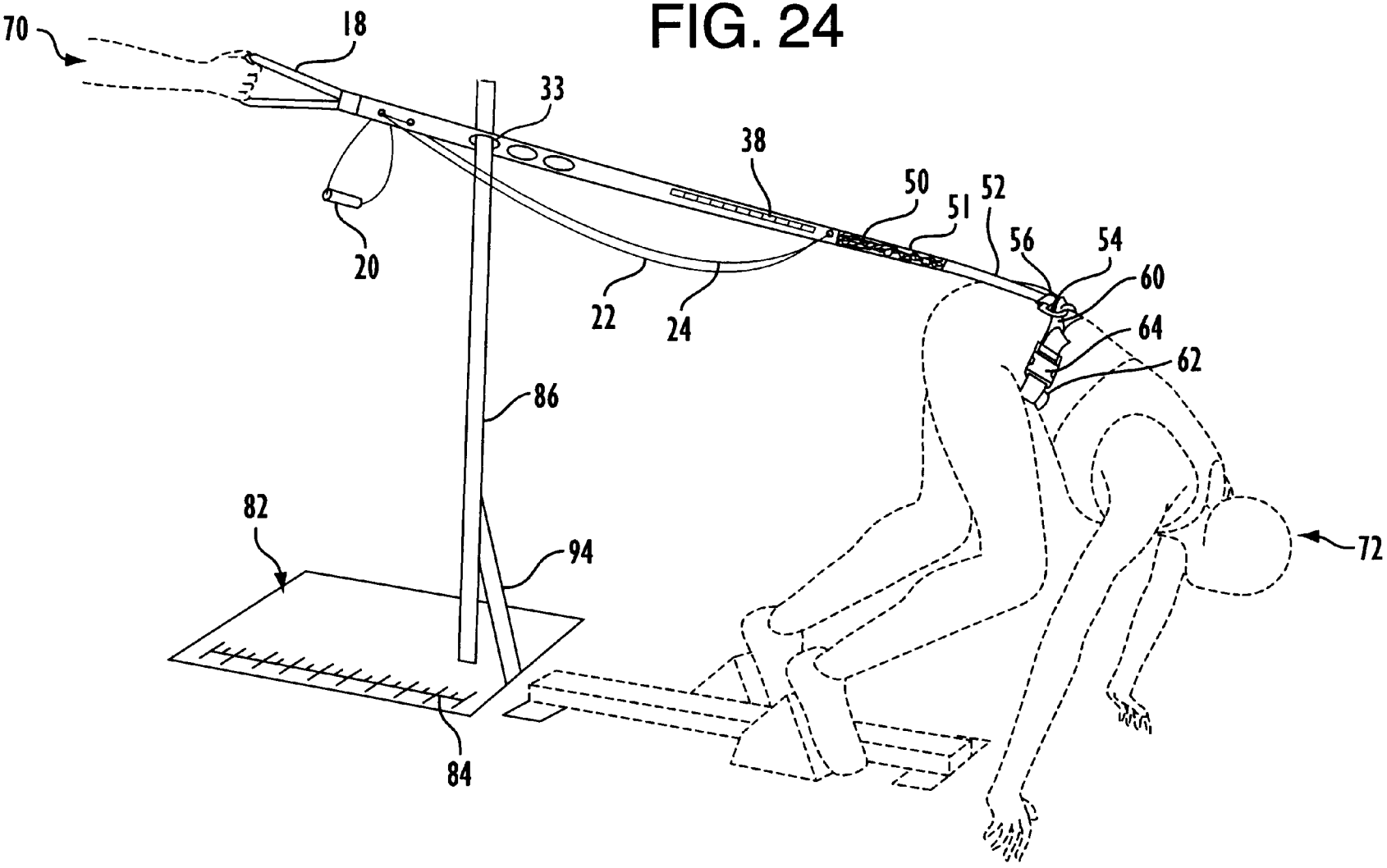
FIG. 24 shows the training apparatus using a stand.
Figure 25:
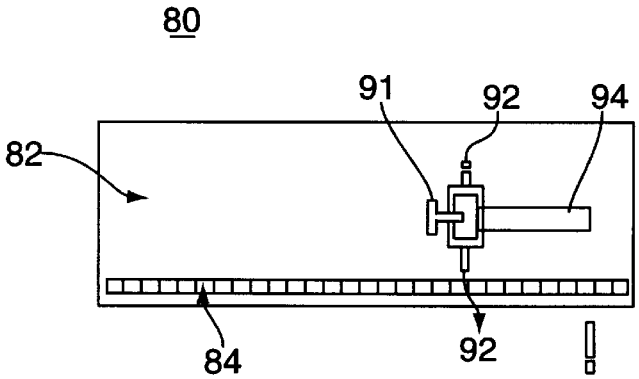
FIG. 25 shows an overhead view of the stand.
Figure 26:
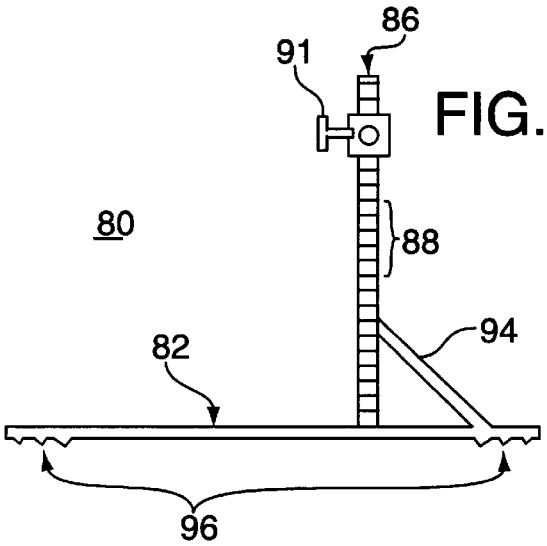
FIG. 26 shows the stand.
Figure 27:
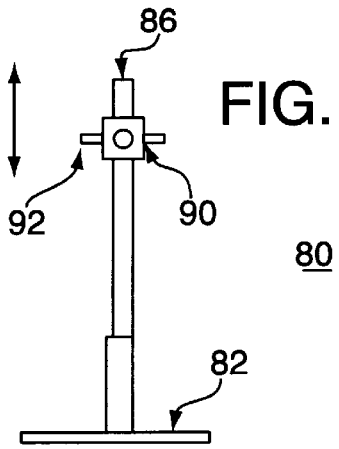
FIG. 27 shows the stand.
Figure 28A:
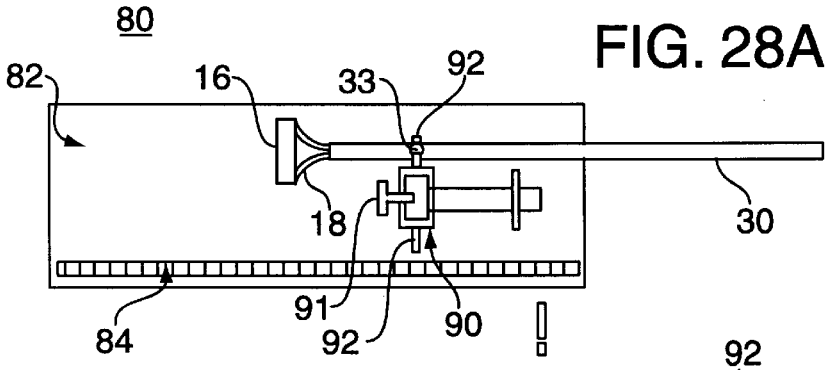
FIG. 28A shows the stand.
Figure 28B:
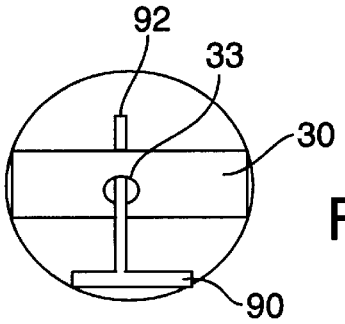
FIG. 28B shows another view of the stand.

In another preferred embodiment (FIGS. 23–28B) a calibration stand (80) may be used to allow accurate and incremental adjustments both vertically and horizontally in applying the surmountable resistance at any one of many points or at any one of many short phases throughout the action or exercise. This embodiment utilizes small holes (33) (e.g., calibration grommets, eyelets, etc.) located along the first end of the "Y" shaped strap (30). The holes are designed to receive a peg (92) (FIGS. 28A and 28B) located on the calibration stand (80) or may be large enough to receive the upright member (86) (FIG. 24). The stand may consist of a flat platform (82) of sufficient dimensions to keep the stand upright without outside support. The calibration stand may be large enough for an average person to place his foot on the platform to secure its place when the stand is in use. The stand may optionally be secured to the floor or ground by other methods (e.g., bolts, straps, clamps, etc.). The top of the platform may have calibration marks (84) that may be aligned with a permanent mark on a surface (e.g., ground, floor, track, etc.) in order to measure horizontal distances from the athlete. Perpendicular to the platform is an upright member (86). The upright member (86) also may have calibrated marks or notches (88) to measure vertical distances to the athlete. The upright member may be fitted with an adjustable collar (90) that slides and locks along the upright member (86). The collar may utilize a locking pin (91) to fasten to the upright member. At least one calibration peg (92) may protrude from each side of the collar (90) in order to accept any of the calibration grommets (33). The upright member (86) is affixed to platform (82) and may include an angular support (94) to enhance the stands (80) strength and stability. The platform (82) bottom may have small spiked protrusions (96) to enhance the stand's (80) friction with the ground.

This training technique is used to overload the energy system, particularly the muscle fibers, required to perform an action. This training method leads to the desired end effect of the body's energy system, particularly the neuromuscular system, responding to the overload by increasing the size and strength of the muscle fibers used to accomplish the action and by recruiting additional muscle fibers to perform the action due to the greater resistance.

To accomplish any learned action, the body's energy system and neuromuscular system respond in a learned pattern. Inclusive in this pattern is a series of contractions of the necessary and appropriate muscle fibers to accomplish the learned action. If the required action is changed, the body's response may at first fail or overcompensate in attempting to accomplish the activity. As the body is repeatedly exposed to the changed action, it makes the appropriate adjustments to accomplish the action or exercise successfully (i.e., by adjusting the size and strength of the existing muscle fibers and by recruiting additional or fewer muscle fibers as necessary).

It is an objective of the invention to apply the overload (i.e., additional resistance) at single points or in short phases in order to maintain specificity of the learned action; not to train similar but alternate patterns of action that would not be used by the neuromuscular system when executing the original action. For example, a track start using 10# ankle weights throughout the entire start would condition the body to use a different set of muscle fibers and/or a different time-firing sequence than a track start without the 10# weights. Therefore, it is important to impose the single point or short phase of overload in an otherwise normal sequence of optimal performance of the action.

While the invention has been particularly shown and described with reference to preferred embodiments, it will be understood by those skilled in the art that various changes in form and detail may be made therein without departing from the spirit and scope of the invention.

I claim:

1. A training apparatus comprising:

an anchoring handle;

a belt for surrounding a user's waist;

a tether strap connected to the belt;

a resistance strap attached to the anchoring handle; and a connection material for connecting the resistance strap to the tether strap.

2. A training apparatus, according to claim 1, wherein the resistance strap further comprises:

a durable strap with a first end connected to said anchoring handle and a second end split into a first strap and a second strap for attaching to said tether strap.

3. A training apparatus, according to claim 2, wherein the first end of the resistance strap further comprises:

the first end having a plurality of holes for receiving a peg.

4. A training apparatus, according to claim 1, wherein said resistance strap further comprises:

a durable strap with a first end connected to said anchoring handle and a second end split into a first strap and a second strap for attaching to said tether strap;

said first strap has an outer side and an interior side with hook and loop fastener located on the interior side; and said second strap has an outer side and an interior side with hook and loop fastener located on the interior side.

5. A training apparatus, according to claim 3, wherein the tether strap further comprises:

a first side and a second side wherein the first side and the second side each have a hook and loop fastener mate for the hook and loop fastener located on the interior side of the first strap and the second strap.

6. A training apparatus, according to claim 1, wherein the anchoring handle is a nylon strap.

7. A training apparatus, according to claim 1, wherein the anchoring handle is a nylon strap with a padded cushion.

8. A training apparatus, according to claim 1, wherein the belt is a nylon strap.

9. A training apparatus, according to claim 1, wherein the belt is a nylon strap with a padded cushion.

10. A training apparatus, according to claim 7, wherein the belt is secured to the user's waist by hook and loop fasteners.

11. A training apparatus, according to claim 7, wherein the belt is secured to the user's waist by a buckle.

12. A training apparatus, according to claim 1, wherein the connection ring is a metal ring.

13. A training apparatus, according to claim 1, wherein the connection ring is a cloth loop.

14. A training apparatus, according to claim 2, wherein the second end of the resistance strap further comprises a resistance determiner.

15. A training apparatus, according to claim 13, wherein the resistance determiner is a calibrated resistance ruler that allows the monitor to determine the amount of resistance applied during training.

16. A training apparatus comprising:

an anchoring handle for a controller to grasp;

a belt for surrounding a user's waist;

a tether strap connected to the belt;

a resistance strap attached to the anchoring handle; and a connection material for connecting the resistance strap to the tether strap.

17. A training apparatus, according to claim 15, wherein the connection material will release the tether strap from the resistance strap when a predetermined amount of force is reached.

18. A training apparatus comprising:

means for anchoring;

means for encircling user's waist;

means for connecting said means for encircling to a tether means;

means for resistance connected to said means for anchoring;

means for attaching said means for resistance to said tether means.

19. A training apparatus, according to claim 17, further comprising:

means for monitoring an amount of resistance to be applied, from the resistance means, located on an outer side of the resistance means;

means for releasing said resistance means from said tether means.

20. A training apparatus, according to claim 17, wherein the means for anchoring further comprises a cushioning means.

21. A training apparatus, according to claim 17, wherein the means for encircling further comprises an securing means.

22. A resistance training method using a releasable tether attached to a user belt comprising the steps of:

securing a waist belt attached to a tether strap around a user;

attaching a resistance strap to the tether strap wherein said resistance strap provides an amount of resistance that the user can overcome under his own power;

anchoring the resistance strap; and tensioning the tether strap and resistance strap to overcome the amount of resistance.

23. A resistance training method using a releasable tether attached to a user belt comprising the steps of:

securing a waist belt attached to a tether strap around a user;

connecting a resistance strap to the tether strap wherein said resistance strap provides an amount of resistance that the user cannot overcome under his own power;

anchoring the resistance strap;

having a monitor pulling a resistance release handle to assist the user in overcoming the amount of resistance.

24. A resistance training method using a releasable tether attached to a user belt comprising the steps of:

securing a waist belt attached to a tether strap around a user;

connecting a resistance strap to the tether strap wherein said resistance strap provides an amount of resistance that the user can overcome under his own power;

anchoring the resistance strap to the ground; and having said user jumping vertically to overcome the amount of resistance.

25. A resistance training method using a releasable tether attached to a user belt comprising the steps of:

securing a waist belt attached to a tether strap around a user;

connecting a resistance strap to the tether strap wherein said resistance strap provides an amount of resistance that the user can overcome under his own power;

anchoring the resistance strap;

having said user jumping horizontally to overcome the amount of resistance.

26. A training apparatus comprising:

a durable strap with a first end connected to an anchoring handle and a second end split into a first strap and a second strap for attaching to a tether strap;

said first strap has an outer side and an interior side with hook and loop fastener located on the interior side; and said second strap has an outer side and an interior side with hook and loop fastener located on the interior side.

27. A training apparatus, according to claim 26, further comprising:

a tether strap having a first side and a second side wherein the first side and the second side each have a hook and loop fastener mate for the hook and loop fastener located on the interior side of the first strap and the second strap.

28. A resistance training method using a releasable tether attached to a user belt comprising the steps of:

securing a waist belt attached to a tether strap around a user;

connecting a resistance strap to the tether strap;

anchoring the resistance strap; and having a monitor actuating a resistance release handle to assist the user.

29. A training apparatus, according to claim 1, further comprising:

a horizontally oriented base member;

an upright member connecting to said base member;

a peg connected to the upright member; and wherein said resistance strap engages said peg.

30. A training apparatus, according to claim 1, further comprising:

a horizontally oriented base member;

an upright member connecting to said base member;

a collar surrounding the upright member;

a peg connected to the collar; and wherein said resistance strap engages said peg.

* * * * *